US009086657B2

(12) United States Patent
Makiura et al.

(10) Patent No.: US 9,086,657 B2
(45) Date of Patent: Jul. 21, 2015

(54) IMAGE FORMING APPARATUS, IMAGE FORMING METHOD, AND NON-TRANSITORY COMPUTER READABLE MEDIUM WITH CONTROL OF POTENTIAL DIFFERENCE BETWEEN COMPONENTS

(75) Inventors: Shinya Makiura, Kanagawa (JP); Masao Ohkubo, Kanagawa (JP); Yasunori Unagida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 224 days.

(21) Appl. No.: 13/607,171

(22) Filed: Sep. 7, 2012

(65) Prior Publication Data

US 2013/0243460 A1 Sep. 19, 2013

(30) Foreign Application Priority Data

Mar. 15, 2012 (JP) ..... 2012-059054

(51) Int. Cl.

*G03G 15/09* (2006.01)
*G03G 15/00* (2006.01)
*G03G 15/02* (2006.01)

(52) U.S. Cl.

CPC ..... *G03G 15/0907* (2013.01); *G03G 15/0266* (2013.01); *G03G 15/553* (2013.01); *G03G 2215/0607* (2013.01); *G03G 2215/0609* (2013.01)

(58) Field of Classification Search

CPC ..... G03G 15/0266; G03G 15/0907; G03G 15/553; G03G 15/065; G03G 2215/0607; G03G 2215/0609
USPC ..... 399/25, 50, 53, 55, 270
See application file for complete search history.

(56) References Cited

U.S. PATENT DOCUMENTS

2001/0021322 A1* 9/2001 Tsuruya et al.
2004/0042813 A1* 3/2004 Takai
2006/0056858 A1* 3/2006 Inami et al.
2006/0062583 A1* 3/2006 Kikuchi ..... 399/25

FOREIGN PATENT DOCUMENTS

JP 10246994 A * 9/1998 ..... G03G 15/00
JP 2007065095 A * 3/2007
JP 2010-250051 A 11/2010

OTHER PUBLICATIONS

Official translation of Image Forming Device by Seiji Yamada, translated Mar. 2014.*

* cited by examiner

*Primary Examiner* — David Gray
*Assistant Examiner* — Laura Roth
(74) *Attorney, Agent, or Firm* — Sughrue Mion, PLLC

(57) ABSTRACT

An image forming apparatus includes an application unit that applies to a holding unit a voltage that generates a potential difference between the holding unit and a photoconductor member such that a toner image is developed on the photoconductor member. The potential difference causes toner included in a two-component developer, held by the holding unit, to be transferred from the holding unit to the photoconductor member. A controller controls the application unit, subsequent to an expiration of an image quality assurance period throughout which a predetermined image quality is assured, such that the potential of the holding unit is decreased according to a decrease of a thickness of a photosensitive film.

17 Claims, 8 Drawing Sheets

IMAGE FORMING APPARATUS, IMAGE FORMING METHOD, AND NON-TRANSITORY COMPUTER READABLE MEDIUM WITH CONTROL OF POTENTIAL DIFFERENCE BETWEEN COMPONENTS

CROSS-REFERENCE TO RELATED APPLICATIONS

This application is based on and claims priority under 35 USC 119 from Japanese Patent Application No. 2012-059054 filed Mar. 15, 2012.

BACKGROUND

Technical Field

The present invention relates to an image forming apparatus, an image forming method, and a non-transitory computer readable medium.

SUMMARY

According to an aspect of the invention, an image forming apparatus is provided. The image forming apparatus includes an application unit that applies to a holding unit a voltage that generates a potential difference between the holding unit and a photoconductor member such that a toner image is developed on the photoconductor member, the potential difference causing toner included in a two-component developer, held by the holding unit, to transfer from the holding unit to the photoconductor member, and a controller that controls the application unit, subsequent to an expiration of an image quality assurance period throughout which a predetermined image quality is assured, such that a potential of the holding unit is decreased in step with wear of the photoconductor member.

BRIEF DESCRIPTION OF THE DRAWINGS

Exemplary embodiment of the present invention will be described in detail based on the following figures, wherein.

DETAILED DESCRIPTION

An exemplary embodiment of the present invention is described in detail below. Described below is an image forming apparatus that develops an image from an electrostatic latent image with a two-component developer. The two-component developer is a mixture of toner and carrier that carries the toner to cause the toner to electrostatically stick to the electrostatic latent image. The technique discussed herein is not limited to this type of image forming apparatus. The technique discussed herein is applicable to any image forming apparatus as long as the image forming apparatus develops an image from an electrostatic latent image using a two-component developer. In the exemplary embodiment, the word "toner" refers to powder particles that are formed by attaching color particles such as carbon to plastic particles having electrostaticity. In the exemplary embodiment, the word "carrier" refers to powder particles that are formed by coating magnetic material with epoxy resin, and are used in a mixture with the toner.

Figure 1:
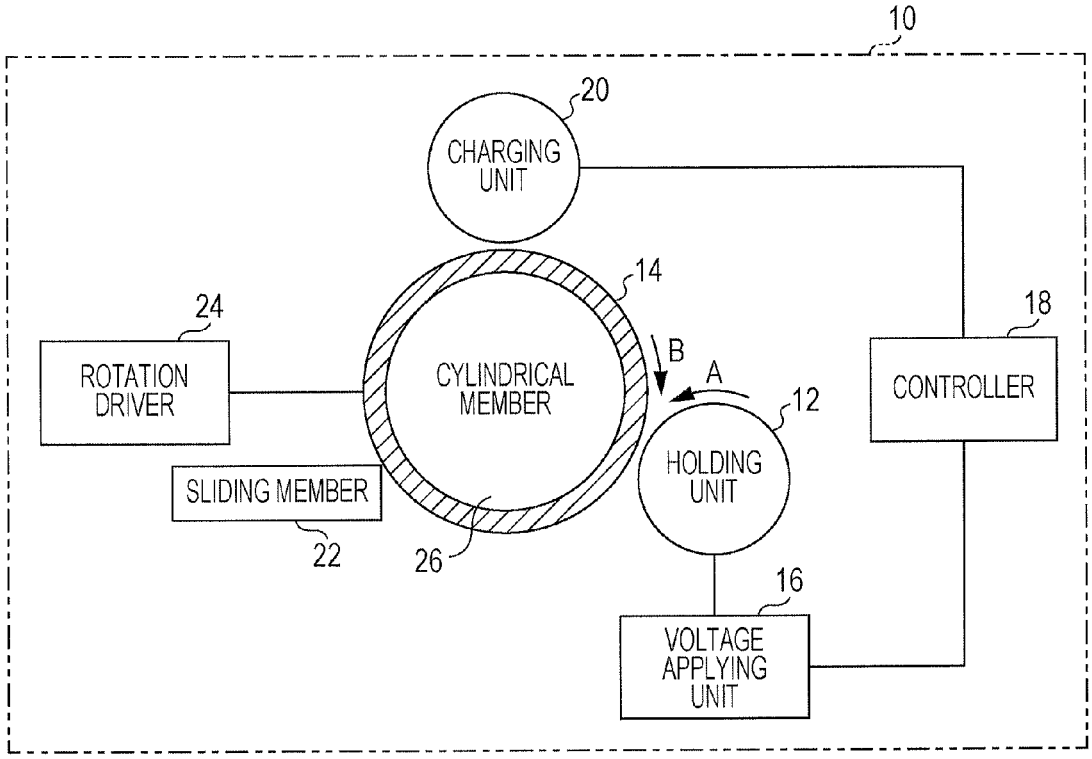
FIG. 1 is a functional block diagram illustrating an example of a function of an image forming apparatus of an exemplary embodiment.

FIG. 1 illustrates an example of a function of an image forming apparatus 10. The image forming apparatus 10 includes holding unit 12, photoconductor member 14, voltage applying unit 16, controller 18, charging unit 20, sliding member 22, rotational driver 24, and cylindrical member 26. The holding unit 12 magnetically holds an electrostatically charged two-component developer. An electrostatic latent image is formed on the photoconductor member 14 when a charged surface of the photoconductor member 14 is exposed to light.

The holding unit 12 is a development roller, for example. The development roller develops an image in accordance with an electrostatic latent image by supplying toner contained in a two-component developer to the electrostatic latent image formed on the surface of the photoconductor member 14 (i.e., the surface of the photoconductor member 14 exposed to the holding unit 12). The development roller rotates in response to torque supplied by a rotational driver such as a motor (not illustrated). FIG. 1 diagrammatically illustrates the development roller that rotates about the central axis thereof in a direction denoted by an arrow A. If the development roller is used for the holding unit 12, the toner contained in the two-component developer attracted onto the outer circumferential surface of the development roller is moved to the surface of the photoconductor member 14 using a potential difference between the holding unit 12 and the photoconductor member 14. The toner image thus results on the photoconductor member 14.

The voltage applying unit 16 applies a development voltage on the holding unit 12 to generate the potential difference between the holding unit 12 and the photoconductor member 14. The potential difference serves to move the toner contained in the two-component developer held by the holding unit 12 to the surface of the photoconductor member 14 and thus to develop the toner image. The potential difference between the holding unit 12 and the photoconductor member 14 becomes larger when the voltage applying unit 16 applies the development voltage to the holding unit 12 than when no voltage is applied to the holding unit 12. When the potential difference reaches a predetermined value, the toner moves onto the surface of the photoconductor member 14.

The toner moved to the photoconductor member 14 is transferred to a recording medium (such as a paper sheet or a transfer belt). However, there are cases in a transfer process where not all the toner on the photoconductor member 14 is transferred to the recording medium. In such a case, part of the toner remains on the photoconductor member 14. The remaining toner (residual toner) is electrostatically or mechanically removed by a cleaning member such as a cleaning blade or a cleaning roller. If the cleaning member is slid on the surface of the photoconductor member 14, i.e., if the residual toner is mechanically removed, the photoconductor member 14 may wear because of friction with the cleaning member. If the wear of the photoconductor member 14 advances, the charged potential on the surface of the photoconductor member 14 gradually decreases. The potential difference between the holding unit 12 and the photoconductor member 14 gradually increases. This may not only cause the toner to move to the photoconductor member 14 but also cause the carrier to move to the photoconductor member 14. The carrier, if moved to the photoconductor member 14, may disperse inside the image forming apparatus 10, and may adversely affect electronic elements inside the image forming apparatus 10.

According to the exemplary embodiment, the controller 18 controls the voltage applying unit 16, subsequent to an expiration of a predetermined period of time, such that the potential of the holding unit 12 is decreased in step with the wear of the photoconductor member 14. The "predetermined period of time" refers to a period throughout which an image quality of an image formed by the image forming apparatus 10 is assured (hereinafter referred to as an "image quality assurance period"). In the exemplary embodiment, one example of the image quality assurance period is a predetermined period throughout which the quality of the photoconductor member 14 is assured. The technique disclosed herein is not limited to this period. For example, the predetermined period throughout which the quality of the photoconductor member 14 is assured may be adjusted by accounting for factors that affect the quality of the photoconductor member 14. The factors may include the environment where the image forming apparatus 10 is installed, and a cumulative operation time of the image forming apparatus 10. More specifically, the photoconductor member 14 may be installed in an environment that accelerates the wear of the photoconductor member 14. In such a case, it is contemplated that the image quality assurance period results from multiplying a period predetermined as the quality assurance period of the photoconductor member 14 by a coefficient less than 1. The "coefficient" may be entered via a receiving device such as a touchpanel or a keyboard. The receiving device may also receive a code representing the environment where the photoconductor member 14 is installed, and a computer may be used to calculate the image quality assurance period in accordance with a table or a calculation equation in response to the input code.

The charging unit 20 charges the photoconductor member 14 to generate the potential difference between the holding unit 12 and the photoconductor member 14. The charging unit 20 is a charging roller, for example. The charging roller supplies the photoconductor member 14 with charge, thereby electrostatically charging the photoconductor member 14. The charging roller rotates about the central axis thereof in response to a torque received from a rotational driver. The potential difference between the holding unit 12 and the photoconductor member 14 is determined by a potential of the holding unit 12 and a potential of the photoconductor member 14. According to the exemplary embodiment, the controller 18 controls the charging unit 20, subsequent to the expiration of the image quality assurance period, such that the charged potential (the potential on the surface of the photoconductor member 14 charged by the holding unit 12) is decreased in step with the wear of the photoconductor member 14.

The sliding member 22 is slid along the photoconductor member 14 to remove the residual toner thereon. The sliding member 22 may be a cleaning blade or a cleaning roller, for example. The cleaning blade or the cleaning roller remains in contact with the photoconductor member 14 to remove the residual toner. The cylindrical member 26 is made of an electrically conductive material, and the entire outer circumferential surface of the cylindrical member 26 is covered with the photoconductor member 14. In the exemplary embodiment, the cylindrical member 26 is coated with the layer of the photoconductor member 14 (hereinafter referred to as a "photosensitve layer"). For simplicity of explanation, it is assumed that the photosensitive layer of the cylindrical member 26 has a relatively uniform thickness free from variations in the image forming apparatus 10 before it is put into service.

The rotational driver 24 generates and transfers torque to the cylindrical member 26. The rotational driver 24 may be a stepping motor. The cylindrical member 26 rotates about the central axis thereof in response to the torque received from the rotational driver 24. FIG. 1 illustrates the cylindrical member 26 that rotates about the central axis thereof in a direction denoted by an arrow B. When the cylindrical member 26 rotates, the sliding member 22 is slid on the photosensitive layer. The photosensitive layer gradually wears out. In the exemplary embodiment, the controller 18 controls the voltage applying unit 16 subsequent to the expiration of the image quality assurance period such that the potential of the holding unit 12 is decreased in step with a physical quantity corresponding to a cumulative amount of rotation of the cylindrical member 26 (such as the cumulative number of rotations, or a cumulative operation time). The cumulative amount of rotation of the cylindrical member 26 may be interpreted as a cumulative amount of sliding movement of the sliding member 22.

A portion of the photosensitive layer of the cylindrical member 26 close to the edges thereof (hereinafter referred to as near-edge portion) is more subject to wear than the other portion of the photosensitive layer of the cylindrical member 26 far from the edges thereof (hereinafter referred to as a far-edge portion). With the cylindrical member 26 rotating over time, the near-edge portion of the photosensitive layer wears out more than the far-edge portion of the photosensitive layer. Subsequent to the expiration of the image quality assurance period, the rate of increase in the potential difference between the near-edge portion of the photosensitive layer coating the cylindrical member 26 and the holding unit 12 is higher than the rate of increase in the potential difference between the far-edge portion of the photosensitive layer coating the cylindrical member 26 and the holding unit 12. If the potential of the holding unit 12 is decreased in step with the wear of the far-edge portion of the photosensitive layer on the cylindrical member 26, the potential difference between the near-edge portion of the photosensitive layer on the cylindrical member 26 and the holding unit 12 may become high enough to move not only the toner but also the carrier from the holding unit 12 to the photoconductor member 14.

If the photosensitive layer partially wears out, the outer surface of the cylindrical member 26 may be partially exposed. In such a case, a potential difference between the exposed portion of the outer surface of the cylindrical member 26 and the holding unit 12 may become smaller than a predetermined potential difference. According to the exemplary embodiment, the controller 18 controls the voltage applying unit 16 such that the potential of the holding unit 12 is decreased, at a ratio of the predetermined potential difference to the potential difference between the exposed portion of the outer surface of the cylindrical member 26 and the holding unit 12, in step with the wear of the photosensitive layer. The potential difference between the exposed portion of the outer surface of the cylindrical member 26 and the holding unit 12 refers to a difference between the charged potential of the exposed portion of the outer surface of the cylindrical member 26 by the charging unit 20 and the potential of the holding unit 12 to which a development voltage is applied. The "predetermined potential difference" refers to a potential difference at which the carrier contained in the two-component developer held by the holding unit 12 is moved to the photosensitive layer.

A difference between the rate of decrease in the potential of the holding unit 12 and the rate of decrease in the potential of the photosensitive layer may lead to an image quality degradation in an image formed on a recording medium. The "image quality degradation" refers to an appearance of an unpredictable bandlike development image on the recording medium. According to the exemplary embodiment, the controller 18 performs a control operation such that the potential of the holding unit 12 and the potential of the photosensitive layer are decreased in step with each other with the rate of decrease in the potential of the holding unit 12 kept matched to the rate of decrease in the potential of the photosensitive layer.

Figure 2:
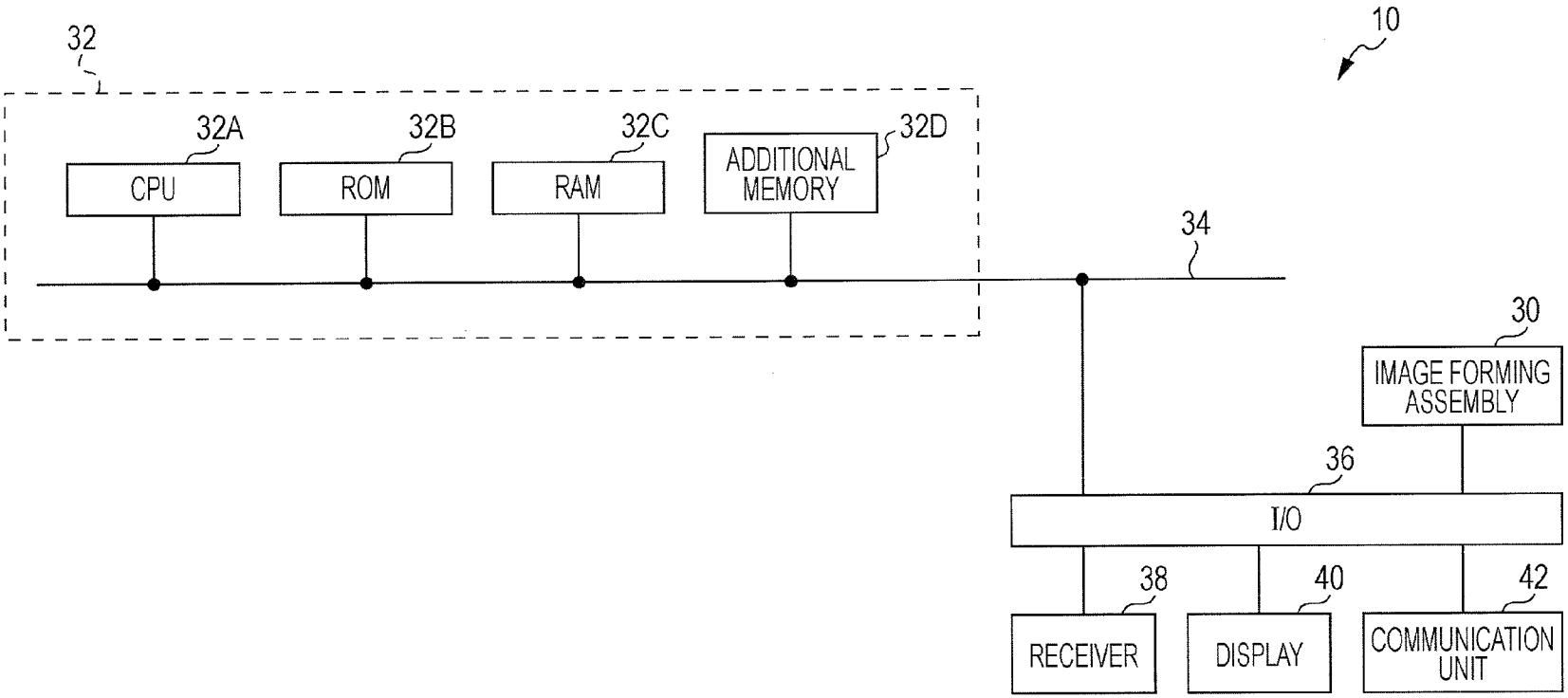
FIG. 2 is a block diagram illustrating an example of electrical elements included in the image forming apparatus of the exemplary embodiment.

The image forming apparatus 10 includes an image forming assembly 30 illustrated in FIG. 2. The image forming assembly 30 includes the holding unit 12, the photoconductor member 14, the voltage applying unit 16, the controller 18, the charging unit 20, the sliding member 22, the rotational driver 24 and the cylindrical member 26. FIG. 2 illustrates electrical elements of the image forming apparatus 10. As illustrated in FIG. 2, the image forming apparatus 10 includes a computer 32. The computer 32 includes central processing unit (CPU) 32A, read-only memory (ROM) 32B, random-access memory (RAM) 32C, and additional memory 32D (such as a hard disk device). The CPU 32A generally controls the image forming apparatus 10. The ROM 32B pre-stores a control program to control the operation of the image forming apparatus 10, and a variety of parameters. The RAM 32C serves as a work area when a variety of programs is executed. The additional memory 32D serves as a non-volatile memory that stores a variety of information that is kept continuously stored even while the image forming apparatus 10 is switched off. The CPU 32A, the ROM 32B, the RAM 32C, and the additional memory 32D are interconnected to each other via a bus 34 including an address bus, a system bus, and other bus. The CPU 32A reads information from each of the ROM 32B, the RAM 32C, and the additional memory 32D and writes information to the RAM 32C and the additional memory 32D.

The image forming apparatus 10 includes an input-output (I/O) interface 36. The I/O interface 36 electrically connects the computer 32 to a variety of input and output devices, and controls exchange of a variety of information between the computer 32 and the input and output devices. In the exemplary embodiment, the input and output devices electrically connected to the computer 32 via the I/O interface 36 and the bus 34 include image forming assembly 30, receiver 38, display 40, and communication unit 42.

The receiver 38 receives an operational input from a user who uses the image forming apparatus 10, and from an operator who maintains and checks the image forming apparatus 10. The receiver 38 may include a light-transmissive touchpanel overlaid on the display 40, an operational button for power on and off, operational setting buttons for inputting a variety of information, and an input device such as a scroll key.

The display 40 displays a variety of information. If the image quality assurance period has expired, the display 40 displays information indicating that the image forming apparatus 10 is outside the image quality assurance period. The display 40 may be a liquid-crystal display, for example. In the exemplary embodiment, a touchpanel display is used for the display 40. The touchpanel display includes a liquid-crystal display serving as the display 40 and a touchpanel serving as part of the receiver 38 overlaid on the liquid-crystal display.

The communication unit 42 is connected to a communication network such as a local-area network (LAN), and the Internet. The communication unit 42 controls exchange of a variety of information with an information processing apparatus (such as a personal computer) connected to the communication network. In the exemplary embodiment, the communication unit 42 receives image forming request information from the information processing apparatus connected to the communication network. The "image forming request information" refers to information that requests a single or a plurality of images to be formed on a paper sheet as an example of the recording medium. The image forming request information includes image information indicating an image to be formed on the paper sheet. In the exemplary embodiment, the CPU 32A receives the image forming request information via the communication unit 42, and then transfers the received image forming request information to the image forming assembly 30.

Figure 3:
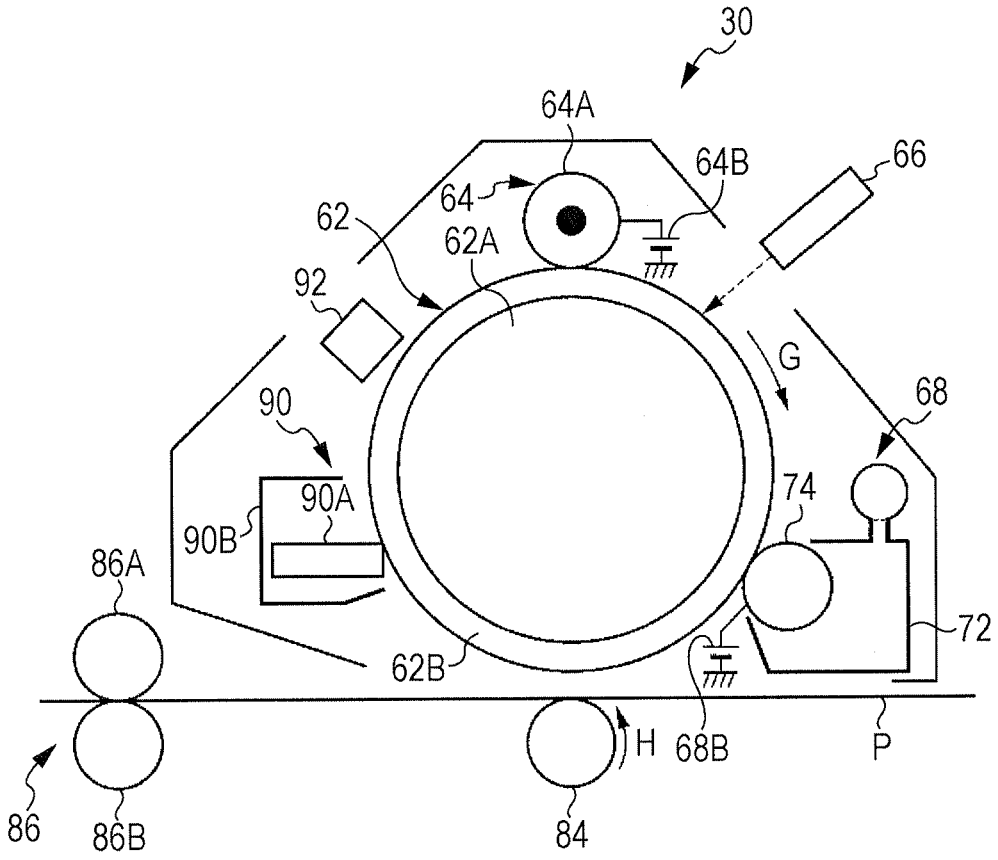
FIG. 3 illustrates an example of elements included in the image forming apparatus.

The image forming assembly 30 forms an image on the paper sheet in Xerography method in response to the image forming request information input from the CPU 32A. The image forming assembly 30 forms the image by transferring to the paper sheet the toner image corresponding to the image represented by the image information included in the input image forming request information. FIG. 3 illustrates an example of elements of the image forming assembly 30. The image forming assembly 30 includes photoconductor drum 62, charging device 64 serving as an example of the charging unit 20, exposure device 66, developing device 68, residual toner removal device 90, and static eliminator 92.

The photoconductor drum 62 includes an electrically conductive base 62A cylindrically shaped and serving as an example of the cylindrical member 26, and a photosensitive film 62B serving as an example of the photoconductor member 14. The photosensitive film 62B includes a photosensitive layer including a charge generating layer and a charge transfer layer laminated onto the outer surface of the base 62A. The charge generating layer includes a photosensitive body containing an organic charge generating material.

The photoconductor drum 62 is arranged such that the outer circumferential surface thereof faces a paper sheet P, and receives torque from a motor (not illustrated), thereby rotating at a predetermined speed in a predetermined direction (denoted by an arrow headed arc G in FIG. 3). The charging device 64 is arranged around the photoconductor drum 62. The charging device 64 includes a charging roller 64A that charges the circumferential surface of the photoconductor drum 62. The charging roller 64A is electrically conductive, and has a circumferential surface in contact with the circumferential surface of the photoconductor drum 62. The charging roller 64A, rotationally driven by the photoconductor drum 62, rotates in concert with the photoconductor drum 62. The charging roller 64A includes a power supply 64B that is an example of the voltage applying unit 16. The charging roller 64A is supplied with a voltage containing a direct current (DC) component and an alternating current (AC) component superimposed on the DC component. The charging roller 64A rotates in concert with the rotation of the photoconductor drum 62 while charging the entire circumferential surface of the photoconductor drum 62 at a predetermined potential.

The exposure device 66 is arranged downstream of the charging device 64 in the rotation direction of the photoconductor drum 62. With the circumferential surface of the photoconductor drum 62 charged by the charging device 64, the exposure device 66 exposes the circumferential surface of the photoconductor drum 62 to light, thereby forming an electrostatic latent image. The exposure device 66 of the exemplary embodiment includes a light-emitting diode (LED) array. The LED array includes multiple LEDs lined in a first scan direction of an image forming process (i.e., a direction perpendicular to the page of FIG. 3). The LED array radiates a light beam responsive to the input image information onto the photoconductor drum 62 with the circumferential surface thereof charged by the charging roller 64A while shifting the light beam in the first scan direction along the axis of the photoconductor drum 62. A potential on an area to which the exposure device 66 radiates the light beam increases, and an electronic latent image is formed on the outer surface of the photoconductor drum 62.

Figure 4:
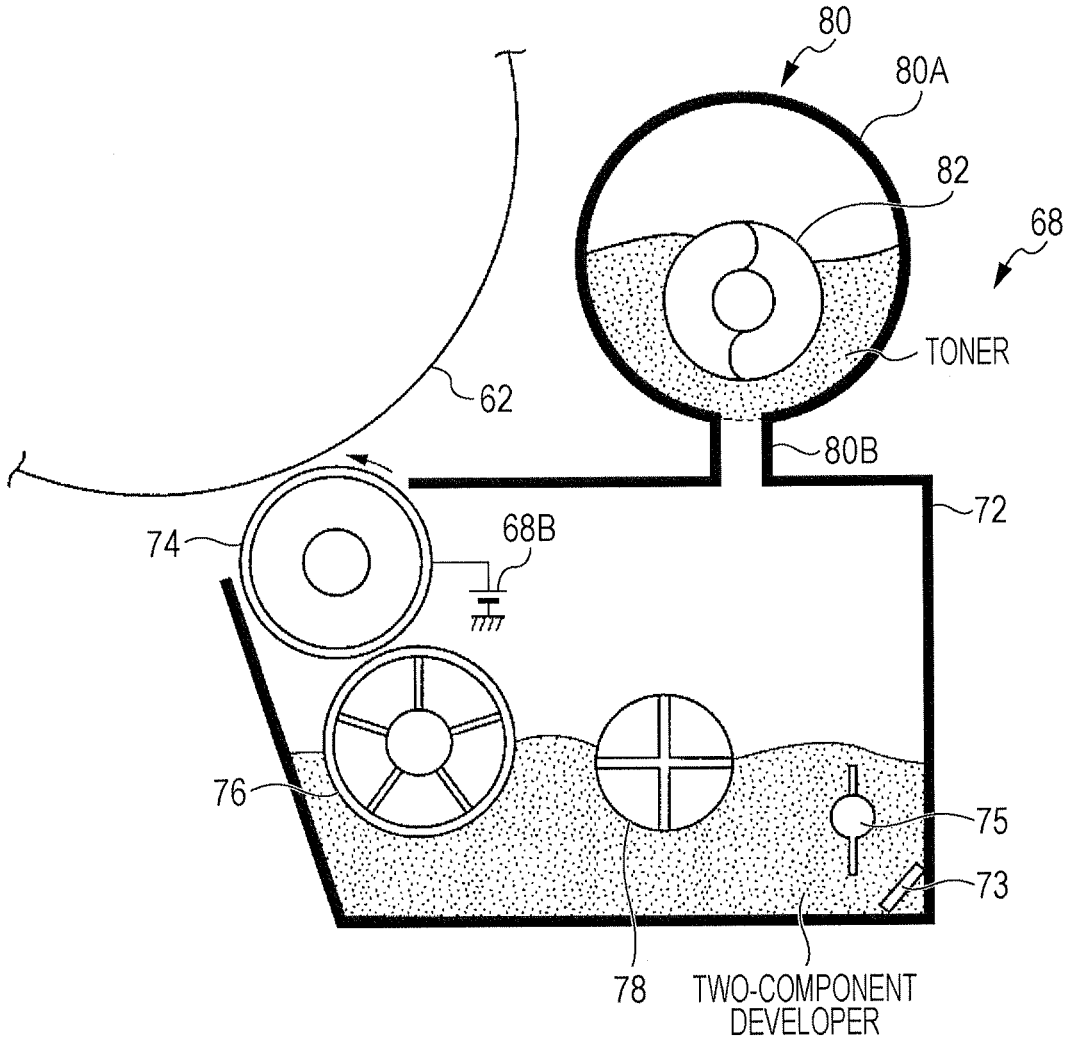
FIG. 4 illustrates an example of elements included in a developing device of the image forming apparatus of the exemplary embodiment.

The developing device 68 is arranged downstream of the exposure device 66 in the rotation direction of the photoconductor drum 62. The developing device 68 develops a toner image as an example of a development image with toner of a predetermined color (for example, black herein) in accordance with the electrostatic latent image formed on the circumferential surface of the photoconductor drum 62. The developing device 68 includes a developer housing 72 containing the two-component developer as illustrated in FIG. 4, for example. A magnetic permeability sensor 73 as an example of the voltage applying unit 16 is fixed onto the bottom of the developer housing 72 in a tilted manner against the inner side wall of the developer housing 72. The magnetic permeability sensor 73 is buried in the two-component developer. In this condition, the magnetic permeability sensor 73 measures magnetic permeability of the two-component developer contained in the developer housing 72.

The developer housing 72 includes a development roller 74. The development roller 74 is supported rotatably about the central axis thereof in a manner such that the circumferential surface thereof remains partially in contact with the circumferential surface of the photoconductor drum 62. The developer housing 72 also includes a developer conveyance roller 76. The developer conveyance roller 76 is arranged next to the development roller 74 and conveys the two-component developer and the toner contained in the two-component developer to the development roller 74.

The developer housing 72 further includes a stirring paddle 75 and a stirring screw 78. Each of the stirring paddle 75 and the stirring screw 78 rotates in response to a torque received from a motor (not illustrated), and stir the two-component developer contained in the developer housing 72. When the two-component developer is stirred, the toner is electrostatically attracted to the carrier. The carrier with the toner sticking thereto is magnetically attracted by having magnetism and then conveyed toward the development roller 74. The carrier is then attracted by the development roller 74 that is a magnetic roller. The developing device 68 includes a power supply 68B. The power supply 68B serving as an example of the voltage applying unit 16 applies a development voltage to the development roller 74 that is arranged to face the circumferential surface of the photoconductor drum 62. The "development voltage" refers to a predetermined voltage that results from superimposing an AC component on a DC component (bias voltage component for development) of the same polarity (negative polarity in the exemplary embodiment) as the circumferential surface of the photoconductor drum 62.

In this way, the development roller 74 is supplied with the development voltage and rotates in a predetermined direction (i.e., the direction denoted by an arrow-headed arc in FIG. 4) in response to the torque received from the motor (not illustrated). The toner then moves to the circumferential surface of the photoconductor drum 62. More specifically, the toner on the circumferential surface of the development roller 74 moves from the development roller 74 to an area on the circumferential surface of the photoconductor drum 62 where a light beam is radiated. An electrostatic latent image thus results.

Arranged upstream of the developer housing 72 is a toner feeder device 80. The toner feeder device 80 includes a toner cartridge 80A storing toner, and a feeder passage 80B that allows the inside of the toner cartridge 80A to communicate with the inside of the developer housing 72. The toner cartridge 80A includes an auger 82 that serves as a conveyance member to convey the toner. The auger 82 is rotationally driven by a motor (not illustrated). With the auger 82 rotating, the toner stored in the toner cartridge 80A is fed into the developer housing 72 via the feeder passage 80B. In the exemplary embodiment, a feed amount of toner in the developer housing 72 is adjusted by a rotation time of the auger 82. Also in the exemplary embodiment, not the carrier but only the toner is fed into the developer housing 72.

Referring to FIG. 3, a transfer roller 84 is arranged downstream of the developing device 68 in the rotation direction of the photoconductor drum 62. The transfer roller 84 is connected to a power supply (not illustrated). The transfer roller 84 is thus supplied with a positive bias voltage. A paper sheet P is transported at a predetermined speed through a nip between the photoconductor drum 62 and the transfer roller 84. The transfer roller 84 is supplied with the positive bias voltage while the paper sheet P passes through the nip between the photoconductor drum 62 and the transfer roller 84, and thus transfers the toner image formed on the circumferential surface of the photoconductor drum 62 to the paper sheet P.

A fixing device 86 is arranged in a transport path of the paper sheet P having the toner image transferred thereon. The fixing device 86 includes a pressure roller 86A and a heater roller 86B opposed to the pressure roller 86A. The paper sheet P transported to the fixing device 86 is picked in and transported through the nip between the pressure roller 86A and the heater roller 86B. The toner image on the paper sheet P is fused while being pressed onto the paper sheet P. The toner image is thus fixed to the paper sheet P.

The residual toner removal device 90 is arranged downstream of the transfer roller 84 in the rotation direction of the photoconductor drum 62. The residual toner removal device 90 includes a cleaning blade 90A, serving as the sliding member 22, and a waste toner bottle 90B. The static eliminator 92 is arranged downstream of the residual toner removal device 90 in the rotation direction of the photoconductor drum 62. The static eliminator 92 removes a residual potential on the circumferential surface of the photoconductor drum 62. After the transfer roller 84 completes the transfer process of the toner image, the residual toner removal device 90 removes the residual toner, paper scraps, and the like on the surface of the photosensitive film 62B, i.e., on the circumferential surface of the photoconductor drum 62. The cleaning blade 90A remains in contact with the outer surface of the rotating photoconductor drum 62, and removes the toner residue, the paper scraps, and the like from the circumferential surface of the photoconductor drum 62. The residual toner, the paper scraps, and the like are removed and then stored in the waste toner bottle 90B. After the residual toner, the paper scraps, and the like are removed from the outer surface of the photoconductor drum 62, the static eliminator 92 removes the residual potential on the circumferential surface of the photoconductor drum 62.

Figure 5:
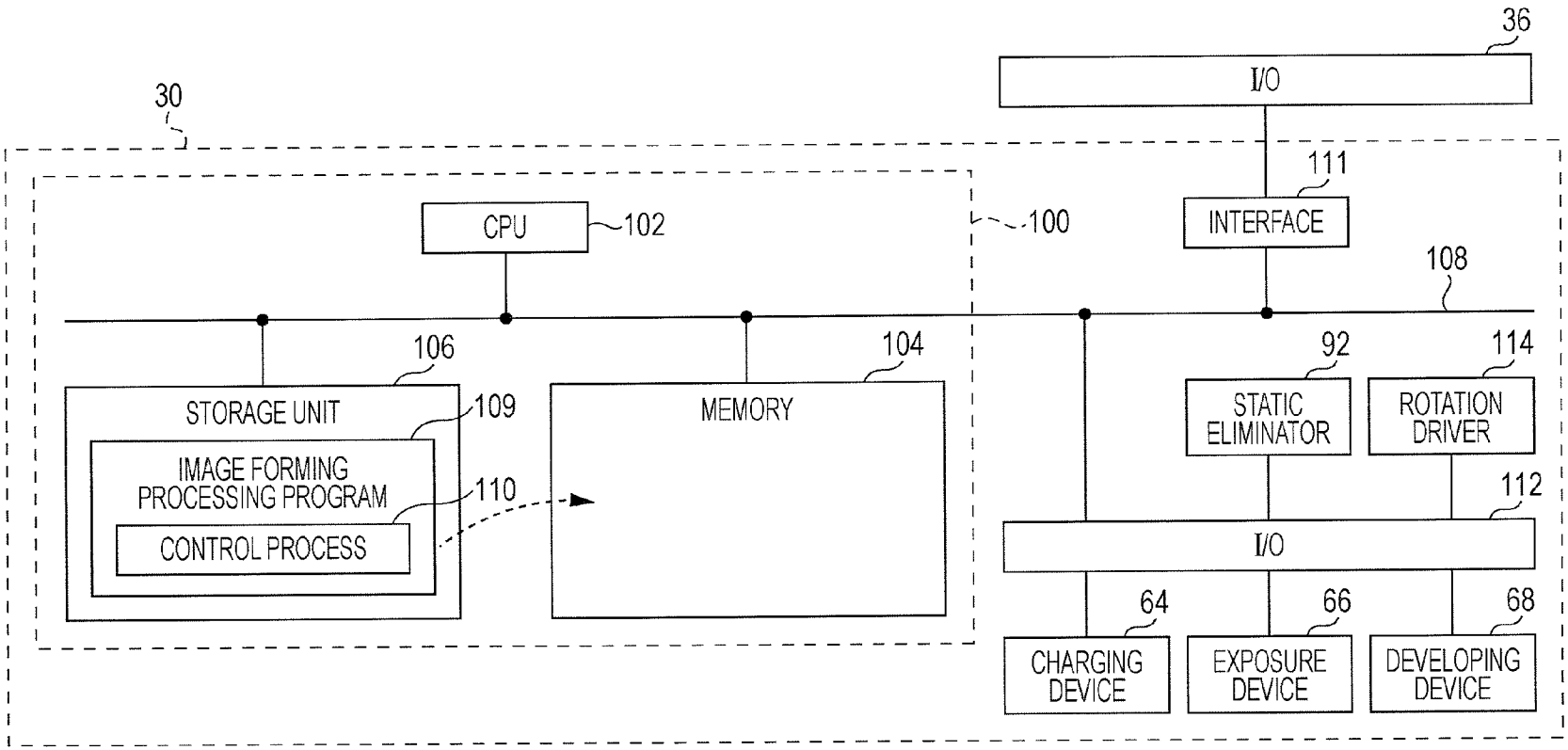
FIG. 5 is a block diagram illustrating electrical elements included in an image forming assembly of the image forming apparatus of the exemplary embodiment.

FIG. 5 illustrates electrical elements of the image forming assembly 30. The controller 18 is implemented by a computer 100 of FIG. 5. The computer 100 includes CPU 102, memory 104, and storage unit 106 that is a non-volatile memory. These elements are interconnected via a bus 108.

The storage unit 106 may be a hard disk device or a flash memory. The storage unit 106 stores an image forming processing program 109. The CPU 102 reads the image forming processing program 109 from the storage unit 106, expands the read image forming processing program 109 on the memory 104, and then successively executes processes included in the image forming processing program 109. The image forming processing program 109 includes a control process 110. By executing the control process 110, the CPU 102 operates as the controller 18 of FIG. 1.

The image forming processing program 109 is read from the storage unit 106 herein. The image forming processing program 109 is not necessarily pre-stored on the storage unit 106. For example, the image forming processing program 109 may be stored on any "portable physical medium" such as a flexible disk (FD), compact-disk ROM (CD-ROM), digital versatile disk (DVD), magneto-optical disk, or IC card, each connected to the computer 100 for use. The computer 100 then retrieves the program from one of the "portable physical disks" and then executes the program. The program may be stored another computer or a server, connected to the computer 100 via the Internet or a local-area network (LAN), and the computer 100 may retrieve the program from the other computer or the server, and then execute the program.

The image forming assembly 30 includes an interface 111. The interface 111 electrically connects an input-output (I/O) interface 36 to a bus 108, and controls exchange of a variety of information between the image forming assembly 30 and the computer 32 of FIG. 2.

The image forming assembly 30 includes an input-output interface 112. The input-output (I/O) interface 112 electrically connects the computer 100 to a variety of input and output devices, and controls exchange of a variety of information between the computer 100 and the input and output devices. In the exemplary embodiment, the input and output devices electrically connected to the computer 100 via the input-output interface 112 and the bus 108 include the charging device 64, the exposure device 66, the developing device 68, the static eliminator 92, and the rotational driver 114. The rotational driver 114 includes multiple motors that generate and supply torque to members in the image forming assembly 30 that rotate in response to the torque received from the respective motors. The rotational driver 114 includes a motor that imparts torque to the transport roller (not illustrated) that transports the paper sheet P. The rotational driver 114 further includes a motor that imparts torque to the photoconductor drum 62, a motor that imparts torque to the charging roller 64A, a motor that imparts torque to the stirring paddle 75, and a motor that imparts torque to the stirring screw 78. The rotational driver 114 further includes a motor that imparts torque to the development roller 74, a motor that imparts torque to the developer conveyance roller 76, a motor that imparts torque to the auger 82, and a motor that imparts torque to the transfer roller 84.

The image forming apparatus 10 of the exemplary embodiment performs an image forming process. The image forming process is performed when the CPU 102 executes the image forming processing program 109. The image forming process is described with reference to FIG. 6. In the following discussion, it is assumed for convenience of explanation that the photoconductor drum 62 rotates in the direction denoted by the arrow G, and that the paper sheet P has been transported to a transfer position.

Figure 6:
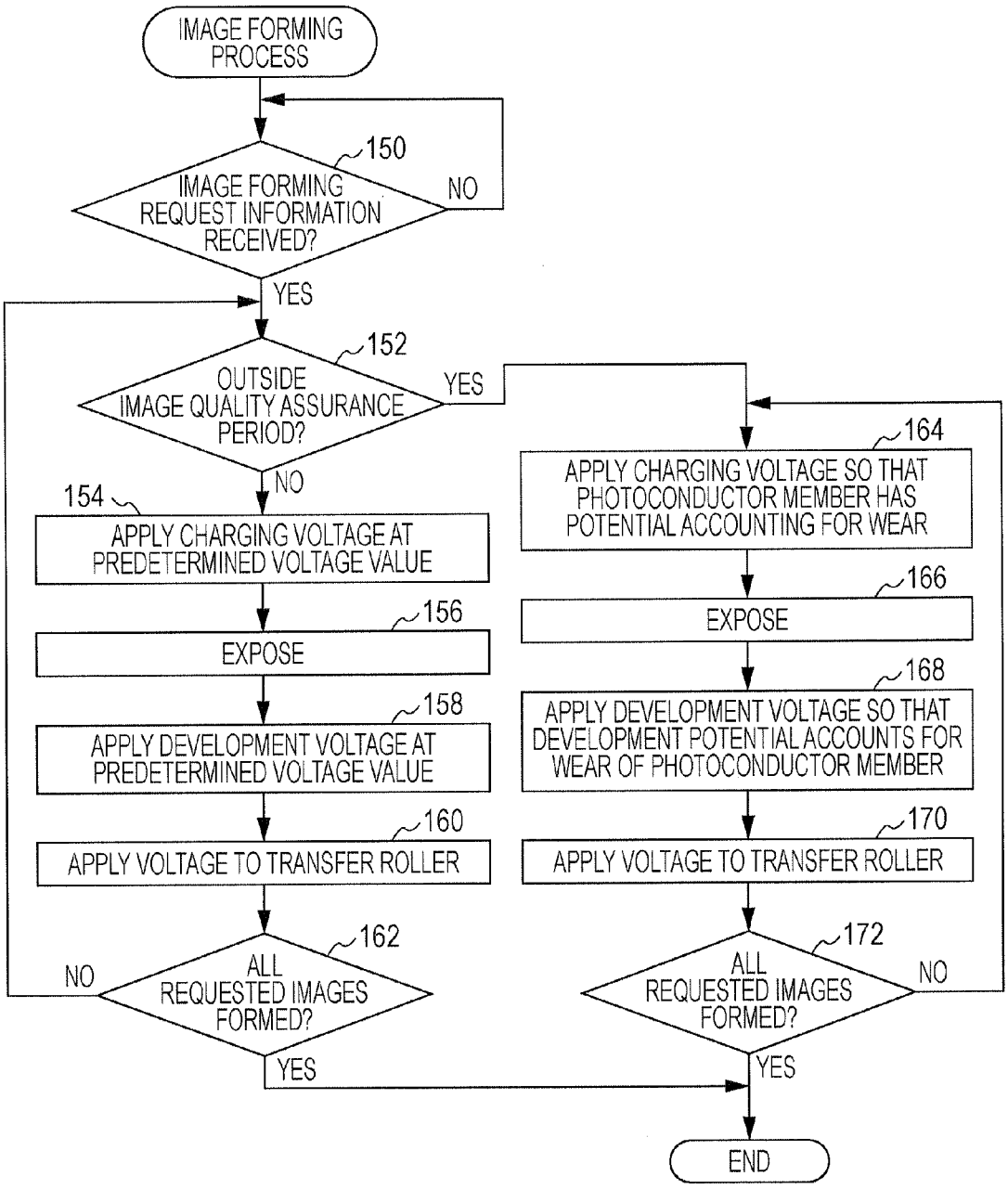
FIG. 6 is a flowchart illustrating a flow of an image forming process of the exemplary embodiment.

In the image forming process of FIG. 6, the CPU 102 determines in step 150 whether the image forming request information has been received. If the CPU 102 determines in step 150 that no image forming request information has been received, step 150 is repeated. If the CPU 102 determines in step 150 that the image forming request information has been received, processing proceeds to step 152.

In step 152, the controller 18 determines whether an image quality assurance period has expired. If the controller 18 determines that the image quality assurance period has not expired, processing proceeds to step 154. In step 154, the voltage applying unit 16 applies a charging voltage at a predetermined charging voltage value to the charging roller 64A. The "predetermined charging voltage value" refers to the magnitude of voltage applied to the charging roller 64A when the image forming process is performed in the image quality assurance period. The "predetermined charging voltage value" is typically a predetermined constant value. With the charging voltage applied to the charging roller 64A, the circumferential surface of the photoconductor drum 62 is charged.

In step 156, the exposure device 66 exposes the circumferential surface of the photoconductor drum 62 to a light beam responsive to the image information included in the image forming request information received in step 150. When the circumferential surface of the photoconductor drum 62 is exposed to the light beam in step 156, an electrostatic latent image is formed on the circumferential surface of the photoconductor drum 62.

In step 158, the voltage applying unit 16 applies a development voltage at a predetermined development voltage value to the development roller 74. The "predetermined development voltage values" include a DC voltage value of a predetermined bias voltage component for development and an AC voltage value of an AC component. The DC voltage value and the AC voltage value are typically predetermined constant values. With the development voltage applied to the development roller 74, the toner moves to the circumferential surface of the photoconductor drum 62 and an image is developed from the electrostatic latent image.

In step 160, the voltage applying unit 16 applies a positive bias voltage to the transfer roller 84 while the paper sheet P passes through the nip between the photoconductor drum 62 and the transfer roller 84. While the paper sheet P passes through the nip, the toner image developed on the circumferential surface of the photoconductor drum 62 is transferred to the paper sheet P.

In step 162, the CPU 102 determines whether all the images of the image information included in the image forming request information received in step 150 have been formed on the paper sheet P. If the CPU 102 determines in step 162 that not all the images of the image information have been formed on the paper sheet P, processing returns to step 152. If the CPU 102 determines in step 162 that all the images of the image information have been formed on the paper sheet P, the CPU 102 completes the image forming process.

If the controller 18 determines in step 152 that the image quality assurance period has expired, processing proceeds to step 164. In step 164, the voltage applying unit 16 applies the charging voltage to the charging roller 64A such that the potential of the circumferential surface of the photoconductor drum 62 charged by the charging roller 64A matches the wear of the photosensitive film 62B. In other words, the voltage applying unit 16 applies the charging voltage to the charging roller 64A such that the potential of the circumferential surface of the photoconductor drum 62 matches the thickness of the photosensitive film 62B at the present point of time. More specifically, in step 164, the voltage applying unit 16 applies the charging voltage to the charging roller 64A such that as the thickness of the photosensitive film 62B decreases the magnitude of the charging voltage applied to the charging roller 64A decreases accordingly.

The thickness of the photosensitive film 62B is estimated by a physical quantity corresponding to a cumulative value of a rotational amount of the photoconductor drum 62 (cumulative rotational amount). The "physical quantity corresponding to the cumulative value of the rotational amount" may be the cumulative number of rotations of the photoconductor drum 62 from the first use of the image forming apparatus 10 or the cumulative number of rotations of the photoconductor drum 62 subsequent to the expiration of the image quality assurance period. The "physical quantity corresponding to the cumulative value of the rotational amount" may be the cumulative operation time of the rotating photoconductor drum 62 from the first use of the image forming apparatus 10, or the cumulative operation time of the rotating photoconductor drum 62 subsequent to the expiration of the image quality assurance period. In step 164, the voltage applying unit 16 thus applies to the charging roller 64A a voltage at a voltage value allocated to a physical quantity corresponding to the cumulative amount.

In step 166, the exposure device 66 exposes the circumferential surface of the photoconductor drum 62 to the light beam responsive to the image information included in the image forming request information received in step 150. With the circumferential surface of the photoconductor drum 62 exposed to the light beam in step 166, the electrostatic latent image results on the circumferential surface of the photoconductor drum 62.

In step 168, the voltage applying unit 16 applies the development voltage to the development roller 74 such that the potential of the circumferential surface of the development roller 74 matches the wear of the photosensitive film 62B. In other words, the voltage applying unit 16 applies the development voltage to the development roller 74 such that the potential of the circumferential surface of the development roller 74 matches the thickness of the photosensitive film 62B at the present point of time. More specifically, in step 168, the voltage applying unit 16 applies the development voltage to the development roller 74 such that as the thickness of the photosensitive film 62B decreases the magnitude of the charging voltage (for example, the DC voltage value of the development bias potential component) applied to the charging roller 64A decreases accordingly. The voltage applying unit 16 thus applies to the development roller 74 a voltage at a voltage value allocated to a physical quantity corresponding to the cumulative amount.

In step 170, the voltage applying unit 16 applies a positive bias voltage to the transfer roller 84 while the paper sheet P passes through the nip between the photoconductor drum 62 and the transfer roller 84. The toner image formed on the circumferential surface of the photoconductor drum 62 is transferred to the paper sheet P.

In step 172, the CPU 102 determines whether all the images of the image information included in the image forming request information received in step 150 have been formed on the paper sheet P. If the CPU 102 determines in step 172 that all the images of the image information included in the image forming request information received in step 150 have not yet been formed on the paper sheet P, processing returns to step 164. If the CPU 102 determines in step 172 that all the images of the image information included in the image forming request information received in step 150 have been formed on the paper sheet P, the determination result in step 172 is affirmative, and the image forming process is now complete.

Figure 7:
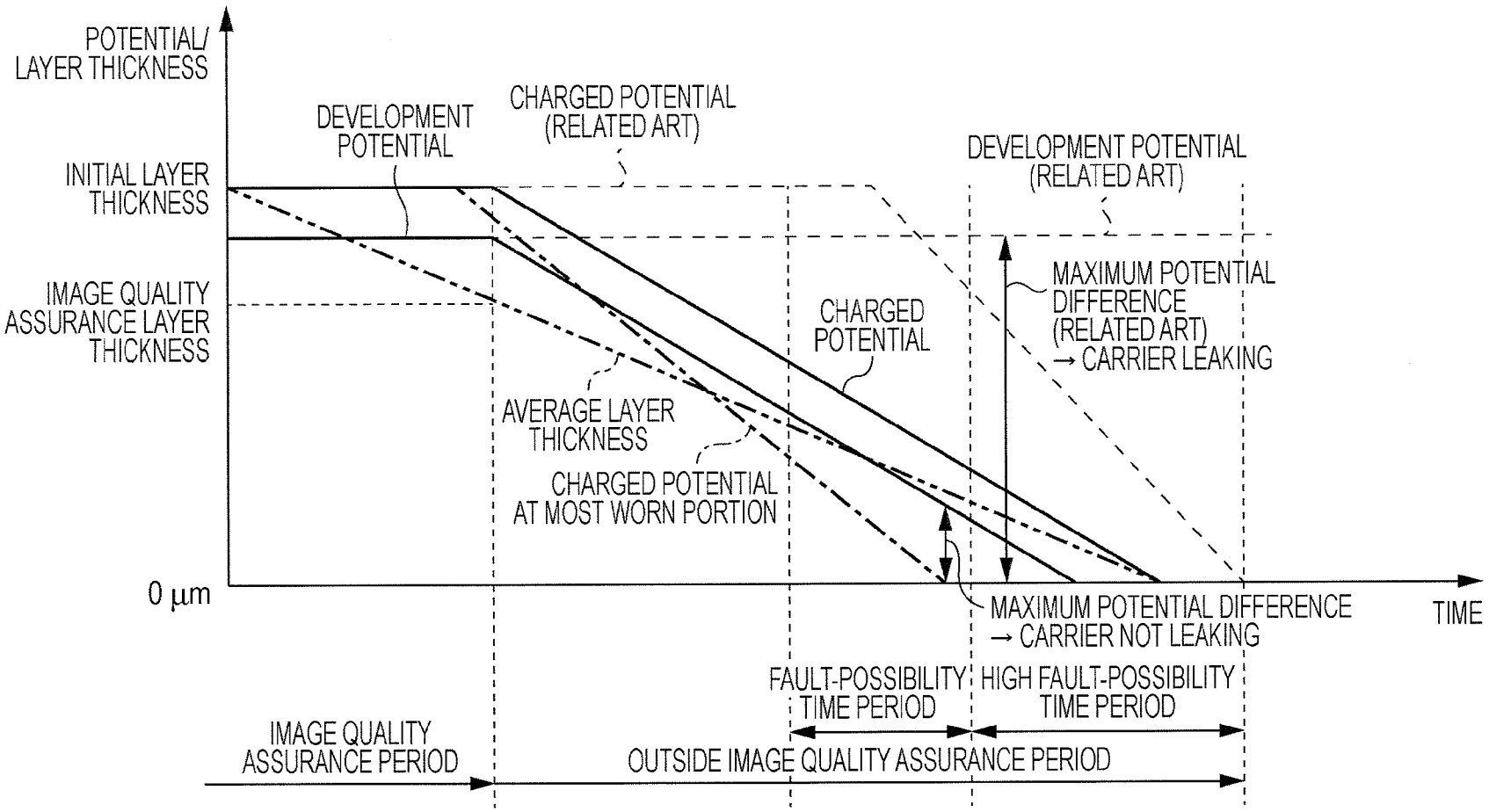
FIG. 7 illustrates an example of transitions of a charged potential and a development potential when the image forming process of the exemplary embodiment is performed.

When the image forming process is performed as illustrated in FIG. 6, the potential of the circumferential surface of the photoconductor drum 62 charged by the charging roller 64A (charged potential) and the potential of the circumferential surface of the development roller 74 (development potential) transition as illustrated in FIG. 7, for example. As illustrated in FIG. 7, the charged potential and the development potential are fixed during the image quality assurance period. In this case, the potential difference between the charted potential and the development potential is maintained at a predetermined value that may assure a predetermined image quality (steps 154 through 162). For example, the charged potential remains at −700 V and the development potential remains at −600 V. If the exposure potential is −100 V, the toner is moved to the photoconductor drum 62 using a potential difference of 500 V between the development potential and the exposure potential.

When the image quality assurance period has expired, the image forming apparatus 10 is outside the image quality assurance period. The charged potential and the development potential start decreasing (steps 164 and 168). The potential difference between the charged potential and the development potential remains unchanged from that during the image quality assurance period (steps 164 and 168). This arrangement controls the generation of a localized dense portion (such as a bandlike toner image portion) in the toner image transferred to the paper sheet P.

If the photosensitive film 62B partially wears out, the outer surface of the base 62A may be partially exposed. The potential difference between the exposed portion and the development roller 74 becomes smaller than the predetermined potential difference. The controller 18 controls the voltage applying unit 16 such that the potential of the development roller 74 is decreased at the ratio of the predetermined potential difference to the potential difference between the exposed portion and the development roller 74, in step with the wear of the photoconductor drum (steps 164 and 168). Even if the photosensitive film 62B partially wears out (to 0 μm) causing the outer surface of the base 62A to be partially exposed, carrier leaking in which the carrier moves together with the toner from the development roller 74 to the photoconductor drum 62 is controlled. More specifically, even in a fault-possibility period of FIG. 6 (during which the possibility of fault generation is higher than the preceding period), the carrier leaking in which the carrier moves together with the toner from the development roller 74 to the photoconductor drum 62 is controlled.

Even if it is in a high fault-possibility time period (during which the possibility of fault generation is even higher than during the fault-possibility time period) subsequent to the fault-possibility time period, the potential difference between the development potential and the charged potential is smaller than when the development potential in the image quality assurance period is maintained. This arrangement controls the carrier leaking in which the carrier is moved together with the toner from the development roller 74 to the photoconductor drum 62. Since the potential difference between the development potential and the charged potential maintained during the image quality assurance period is continuously maintained during the high fault-possibility time period, the generation of the localized dense portion (the bandlike toner image portion) in the toner image transferred to the paper sheet P is controlled.

The image forming apparatus 10 of the exemplary embodiment controls the carrier leaking to the photoconductor drum 62 while also controlling image quality degradation even in a period when related art technique may typically suffer from a high possibility of a fault (high possibility of carrier leaking) and a pronounced image quality degradation. A user may typically wish to judge the time of component replacement themselves and may request that the user be alerted to the time of a component replacement immediately prior to the shifting to an inability phase for the image forming apparatus 10 to be unable to form image (for example, at a phase for the image forming apparatus 10 to be able to form only five pages or so of solid image of sheet size A4). If the user is alerted to the time of component replacement, a message prompting the user to replace the corresponding component may be displayed on the display 40 in the fault-possibility time period or in the high fault-possibility time period until a predetermined end condition is satisfied. (For example, the message may be "please replace the component, or otherwise it would become difficult to guarantee image quality"). Alternatively, if the image quality assurance period has expired, information indicating that the image forming apparatus 10 is outside the image quality assurance period may be continuously displayed on the display 40 as in the related art.

Figure 8:
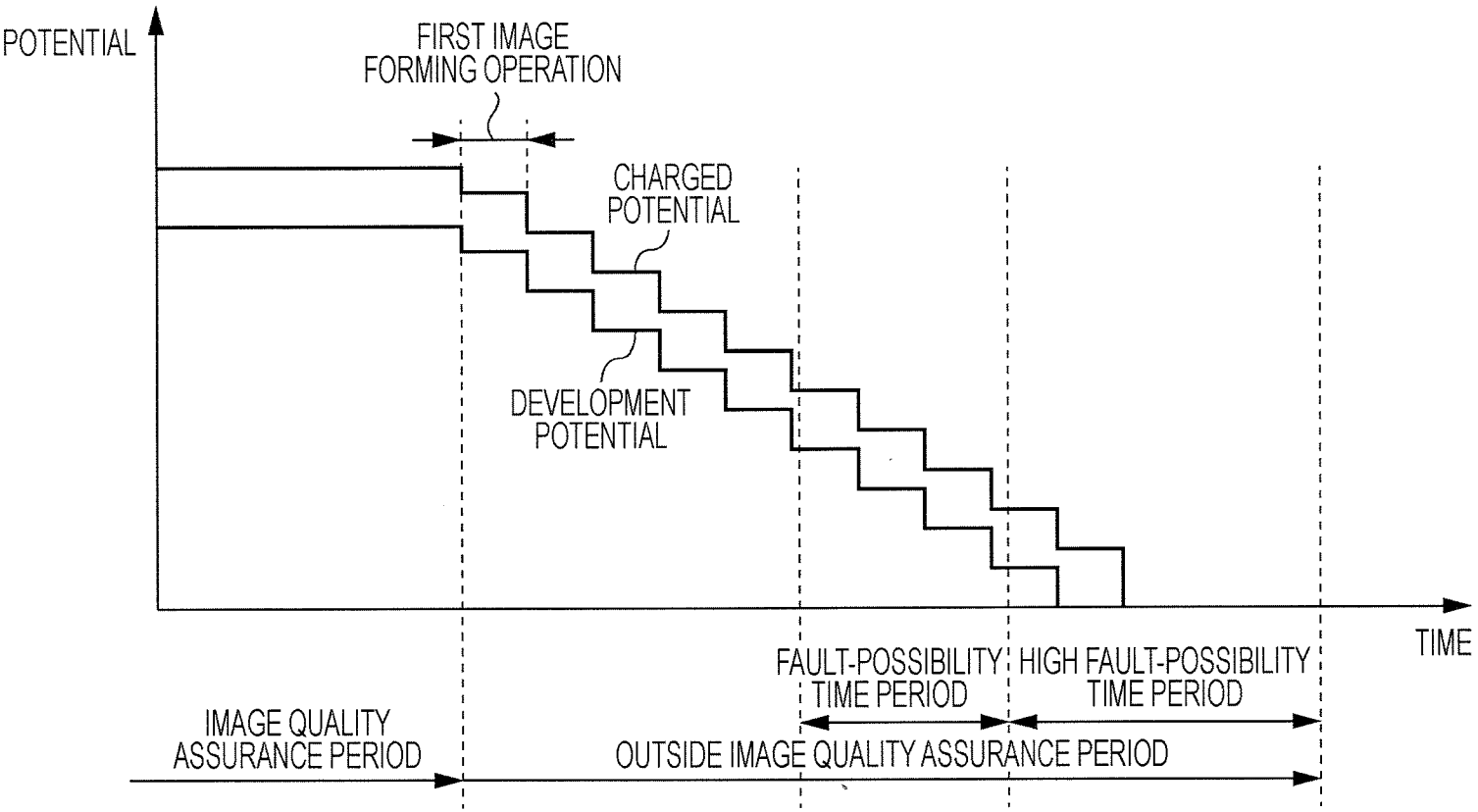
FIG. 8 illustrates how the charged potential and the development potential step down when the image forming process of the exemplary embodiment is performed.

In the exemplary embodiment, the charged potential and the development potential are decreased at a predetermined rate (a fixed gradient (potential/time)). The technique disclosed herein is not limited to this method. As illustrated in FIG. 8, the charged potential and the development potential may be decreased by steps of image forming process unit. FIG. 8 illustrates the charged potential and the development potential that are decreased in a step function. The charged potential and the development potential remain flat during one image forming process. If multiple images not different from each other are consecutively formed on the paper sheet P in one image forming process, a change in the image quality of images formed in time is controlled in comparison with the case in which the arrangement of FIG. 8 is not implemented. If the potential difference between the charged potential and the development potential during the image quality assurance period is continuously maintained after the image quality assurance period expires as illustrated in FIG. 8, the arrangement of FIG. 8 provides the same effect as the exemplary embodiment.

In the exemplary embodiment, the charged potential and the development potential are linearly decreased. The technique disclosed herein is not limited to this method. At least one of the charged potential and the development potential may be decreased non-linearly.

In the exemplary embodiment, the image forming apparatus 10 includes the sliding member 22. The technique disclosed herein is not limited to this arrangement. The sliding member 22 may not be used. As the cylindrical member 26 rotates in use, the photosensitive film 62B formed on the circumferential surface of the cylindrical member 26 becomes gradually thin from the edge portion thereof. After the expiration of the image quality assurance period, at least the development potential, of the charged potential and the development potential, is decreased in step with the physical quantity corresponding to the cumulative amount of rotation of the cylindrical member 26. This arrangement remains effective.

According to the exemplary embodiment, the charged potential and the development potential are decreased in response to an increase in the cumulative amount of rotation of the photoconductor drum 62 and the cumulative amount of rotation time. The technique disclosed herein is not limited to this method. The thickness of the photosensitive film 62B may be measured using a film thickness measuring apparatus, and the charged potential and the development potential may be decreased in accordance with the measured value.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an application unit that applies to a holding unit a voltage that generates a potential difference between the holding unit and a photoconductor member such that a toner image is developed on the photoconductor member, the potential difference causing toner included in a two-component developer, held by the holding unit, to transfer from the holding unit to the photoconductor member;

a controller that controls the application unit, subsequent to an expiration of an image quality assurance period throughout which a predetermined image quality is assured, such that a potential of the holding unit is decreased according to a decrease of a thickness of a photosensitive film, and a cylindrical member that has an outer circumferential surface covered with the photoconductor member wherein if a portion of the outer surface of the cylindrical member is expose as a result of the wear of the photoconductor member, causing a potential difference between the exposed portion and the holding unit to be smaller than a predetermined potential difference at which a carrier contained in the two-component developer is transferred to the photoconductor member, the controller controls the application unit such that the potential of the holding unit is decreased, at a ratio of the predetermined potential difference to the potential difference between the exposed portion and the holding unit, in step with the wear of the photoconductor member.

2. The image forming apparatus according to claim 1, further comprising a charging unit that charges the photoconductor member to generate the potential difference, wherein the controller further controls the charging unit subsequent to the expiration of the image quality assurance period such that a charged potential provided on the photoconductor member by the charging unit is decreased in step with the wear of the photoconductor member.

3. The image forming apparatus according to claim 2, wherein the controller controls the application unit and the charging unit subsequent to the expiration of the image quality assurance period such that the potential of the holding unit and the charged potential of the photoconductor member are decreased in step with the wear of the photoconductor member while the potential difference is maintained to within a predetermined range.

4. The image forming apparatus according to claim 3, wherein the controller maintains a rate of decrease of the potential of the holding unit and a rate of decrease of the charged potential of the photoconductor member in concert with each other.

5. The image forming apparatus according to claim 4, wherein the cylindrical member rotates about the central axis thereof in response to a torque received from a rotational driver, wherein the controller controls the application unit subsequent to the expiration of the image quality assurance period such that the potential of the holding unit is decreased in step with a physical quantity corresponding to a cumulative amount of rotation of the cylindrical member.

6. The image forming apparatus according to claim 3, wherein the cylindrical member rotates about the central axis thereof in response to a torque received from a rotational driver, wherein the controller controls the application unit subsequent to the expiration of the image quality assurance period such that the potential of the holding unit is decreased in step with a physical quantity corresponding to a cumulative amount of rotation of the cylindrical member.

7. The image forming apparatus according to claim 3, further comprising a sliding member that slides on the photoconductor member to remove residual toner.

8. The image forming apparatus according to claim 2, wherein the controller maintains a rate of decrease of the potential of the holding unit and a rate of decrease of the charged potential of the photoconductor member in concert with each other.

9. The image forming apparatus according to claim 8, wherein the cylindrical member rotates about the central axis thereof in response to a torque received from a rotational driver, wherein the controller controls the application unit subsequent to the expiration of the image quality assurance period such that the potential of the holding unit is decreased in step with a physical quantity corresponding to a cumulative amount of rotation of the cylindrical member.

10. The image forming apparatus according to claim 2, wherein the cylindrical member rotates about the central axis thereof in response to a torque received from a rotational driver, wherein the controller controls the application unit subsequent to the expiration of the image quality assurance period such that the potential of the holding unit is decreased in step with a physical quantity corresponding to a cumulative amount of rotation of the cylindrical member.

11. The image forming apparatus according to claim 2, further comprising a sliding member that slides on the photoconductor member to remove residual toner.

12. The image forming apparatus according to claim 2, wherein the image quality assurance period is a period within which the quality of the photoconductor member is assured.

13. The image forming apparatus according to claim 1, wherein the cylindrical member rotates about the central axis thereof in response to a torque received from a rotational driver, wherein the controller controls the application unit subsequent to the expiration of the image quality assurance period such that the potential of the holding unit is decreased in step with a physical quantity corresponding to a cumulative amount of rotation of the cylindrical member.

14. The image forming apparatus according to claim 1, further comprising a sliding member that slides on the photoconductor member to remove residual toner.

15. The image forming apparatus according to claim 1, wherein the image quality assurance period is a period within which the quality of the photoconductor member is assured.

16. An image forming method comprising:

applying to a holding unit a voltage that generates a potential difference between the holding unit and a photoconductor member such that a toner image is developed on the photoconductor member, the potential difference causing toner included in a two-component developer, held by the holding unit, to transfer from the holding unit to the photoconductor member; and controlling the voltage applying, subsequent to an expiration of an image quality assurance period throughout which a predetermined image quality is assured, such that a potential of the holding unit is decreased according to a decrease of a thickness of a photosensitive film, causing a potential difference between an exposed portion of an outer surface of a cylindrical member, as a result of the wear on the photoconductor member, and the holding unit to be smaller than a predetermined potential difference at which a carrier contained in the two-component developer is transferred to the photoconductor member, controlling the voltage such that the potential of the holding unit is decreased, at a ratio of the predetermined potential difference to the potential difference between the exposed portion and the holding unit, in step with the wear of the photoconductor member.

17. A non-transitory computer readable medium storing a program causing a computer to execute a process for forming an image, the process comprising:

applying to a holding unit a voltage that generates a potential difference between the holding unit and a photoconductor member such that a toner image is developed on the photoconductor member, the potential difference causing toner included in a two-component developer, held by the holding unit, to transfer from the holding unit to the photoconductor member; and controlling the voltage applying, subsequent to an expiration of an image quality assurance period throughout which a predetermined image quality is assured, such that a potential of the holding unit is decreased according to a decrease of a thickness of a photosensitive film;

causing a potential difference between an exposed portion of an outer surface of a cylindrical member, as a result of the wear on the photoconductor member, and the holding unit to be smaller than a predetermined potential difference at which a carrier contained in the two-component developer is transferred to the photoconductor member, controlling the voltage such that the potential of the holding unit is decreased, at a ratio of the predetermined potential difference to the potential difference between the exposed portion and the holding unit, in step with the wear of the photoconductor member.

* * * * *